US010260755B2

(12) United States Patent
Bach

(10) Patent No.: US 10,260,755 B2
(45) Date of Patent: Apr. 16, 2019

(54) COOKING APPLIANCE AND METHOD FOR LIMITING COOKING UTENSIL TEMPERATURES USING TIME-TO-TARGET CRITERIA

(71) Applicant: Haier US Appliance Solutions, Inc., Wilmington, DE (US)

(72) Inventor: James Carter Bach, Seymour, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 377 days.

(21) Appl. No.: 15/206,400

(22) Filed: Jul. 11, 2016

(65) Prior Publication Data

US 2018/0010805 A1 Jan. 11, 2018

(51) Int. Cl.

| | |
|---|---|
| ***H05B 1/02*** | (2006.01) |
| ***F24C 7/08*** | (2006.01) |
| ***H05B 3/74*** | (2006.01) |
| ***H05B 6/06*** | (2006.01) |

(52) U.S. Cl.

CPC ..... *F24C 7/088* (2013.01); *H05B 1/0261* (2013.01); *H05B 3/748* (2013.01); *H05B 6/062* (2013.01)

(58) Field of Classification Search

CPC ..... F24C 7/088; H05B 1/0261; H05B 3/748; H05B 6/062; H05B 3/0076

USPC ..... 219/491, 492, 497, 506, 702, 710, 719

See application file for complete search history.

(56) References Cited

U.S. PATENT DOCUMENTS

| | | | | |
|---|---|---|---|---|
| 4,620,083 | A | 10/1986 | Andre | |
| 4,692,597 | A * | 9/1987 | Tsuda | H05B 6/6458 219/492 |
| 4,913,038 | A * | 4/1990 | Burkett | A47J 37/1266 99/329 R |
| 5,398,597 | A * | 3/1995 | Jones | A47J 37/1266 219/492 |
| 5,990,454 | A * | 11/1999 | Westerberg | H05B 3/0076 219/411 |
| 6,933,477 | B2 * | 8/2005 | Becker | F24C 7/082 219/411 |
| 7,022,949 | B2 * | 4/2006 | Shukla | F24C 7/082 219/452.11 |
| 9,131,537 | B2 | 9/2015 | Broders et al. | |
| 9,132,302 | B2 | 9/2015 | Luongo et al. | |
| 2004/0149736 | A1 * | 8/2004 | Clothier | H05B 6/062 219/627 |
| 2016/0076775 | A1 | 3/2016 | Luongo et al. | |
| 2016/0294219 | A1 * | 10/2016 | Van Wageningen | H02J 50/12 |

* cited by examiner

*Primary Examiner* — Mark H Paschall

(74) *Attorney, Agent, or Firm* — Dority & Manning, P.A.

(57) ABSTRACT

Cooking appliances and methods for operating cooking appliances are provided. In one exemplary embodiment, a method for operating a cooking appliance is provided. The method includes providing power to the heating source according to a first control mode; determining whether to transition from the first control mode to a second control mode and, if so, then providing power to the heating source according to the second control mode. The method further includes determining whether to transition from the second control mode to a third control mode and, if so, then providing power to the heating source according to the third control mode. The cooking appliances and methods include features for limiting cooking utensil temperatures using time-to-target criteria.

20 Claims, 10 Drawing Sheets

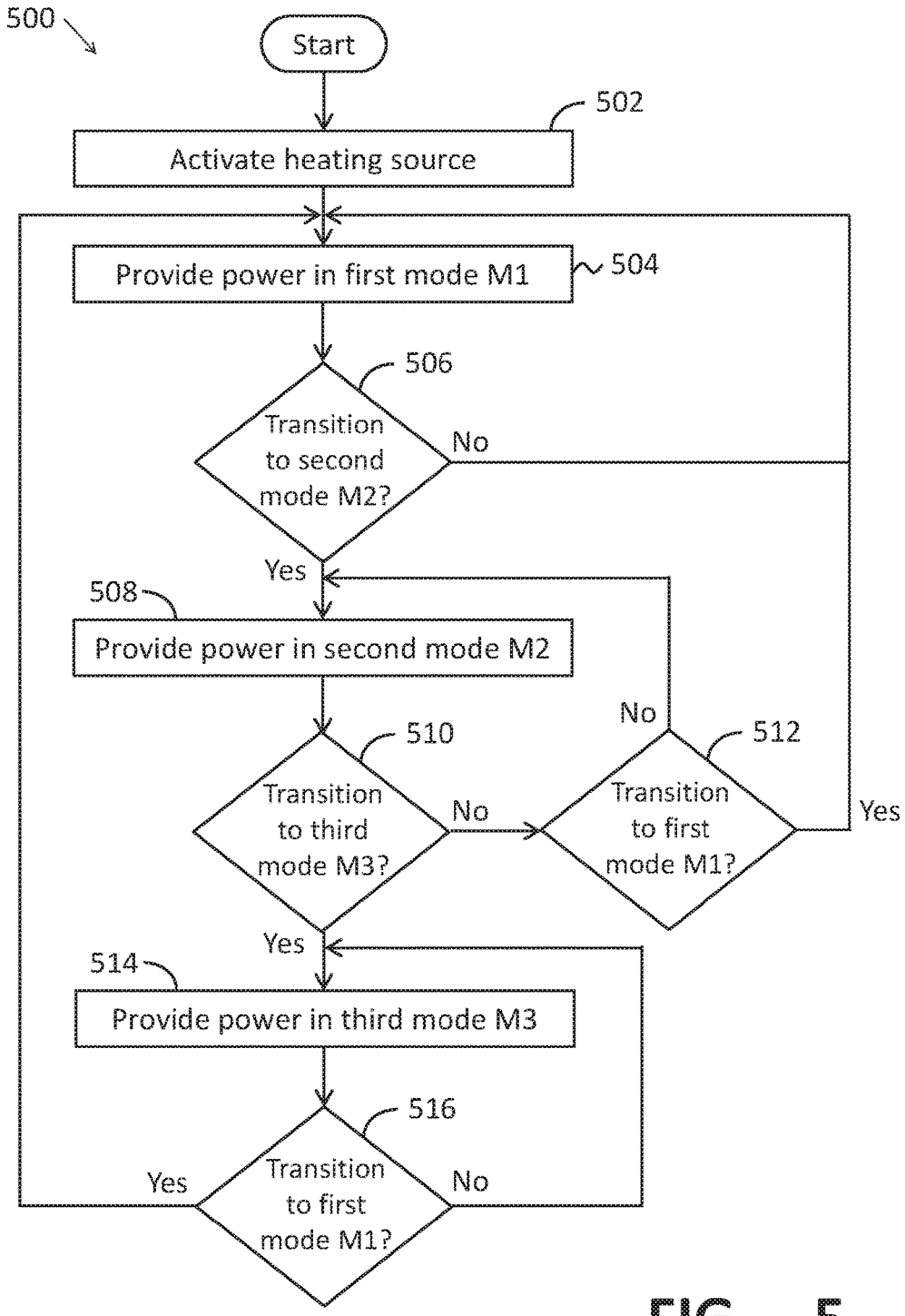
FIG. – 5 –

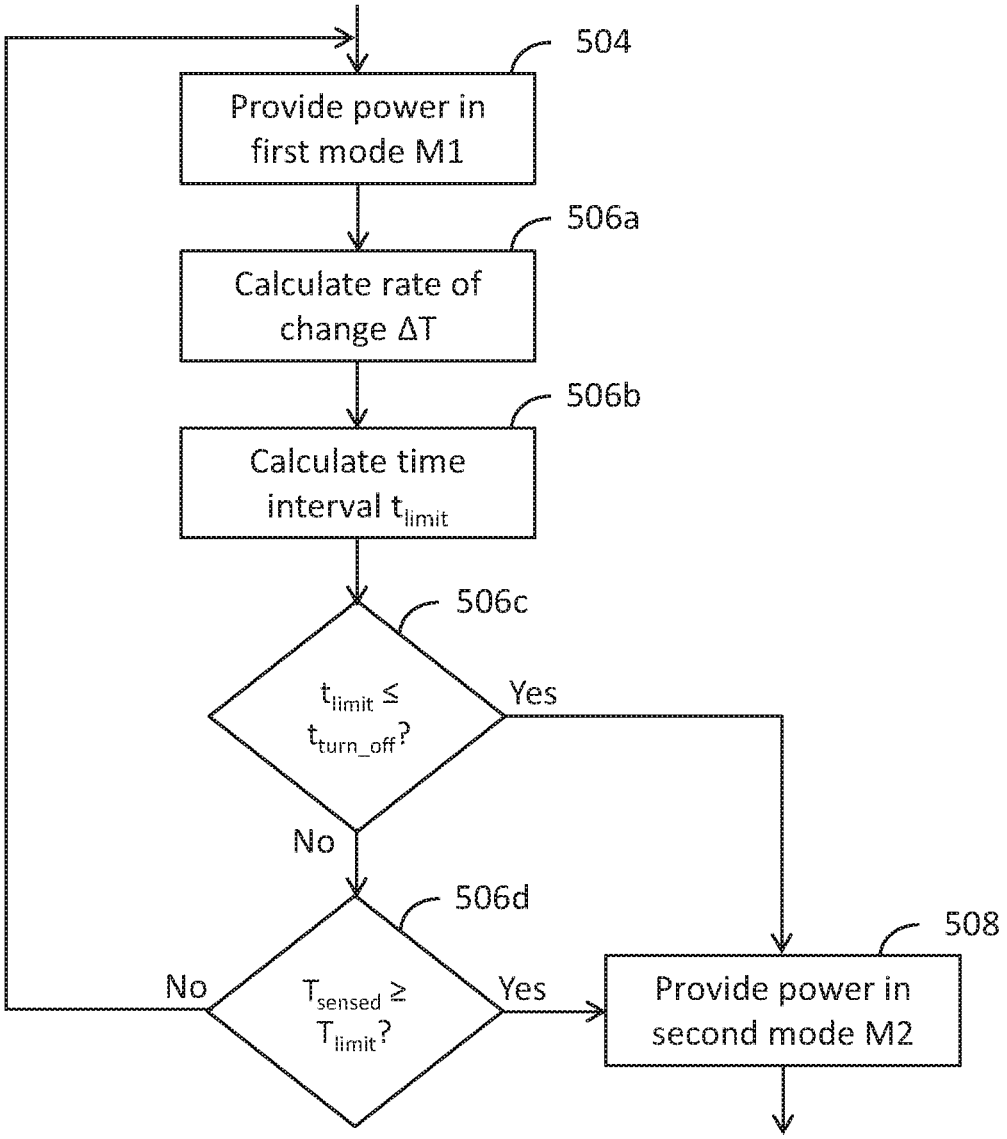
FIG. – 5A –

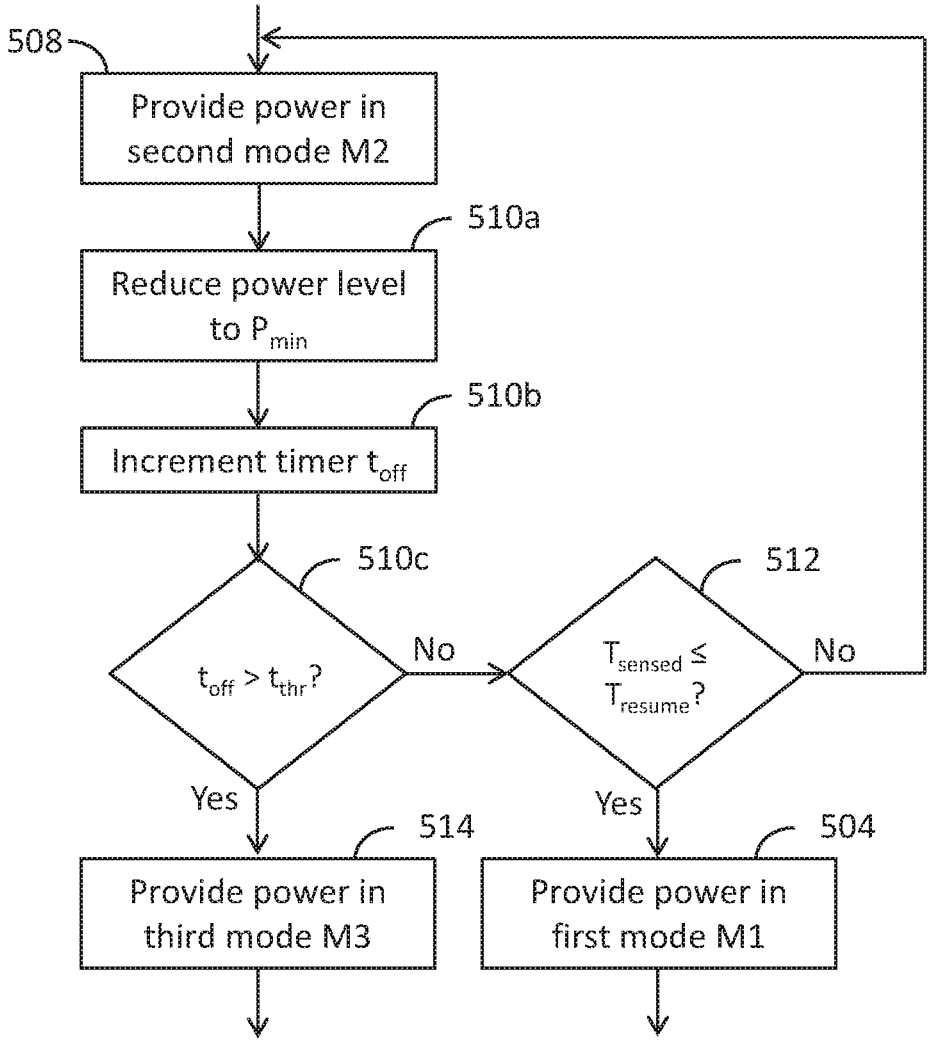
FIG. – 5B –

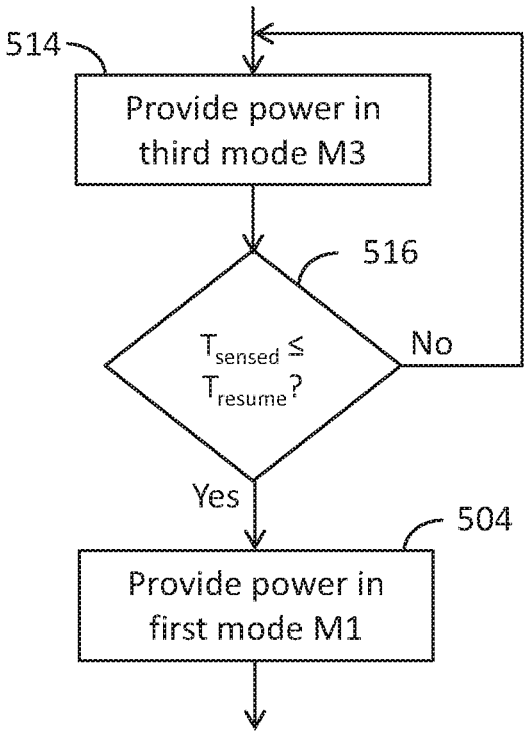
FIG. – 5C –

COOKING APPLIANCE AND METHOD FOR LIMITING COOKING UTENSIL TEMPERATURES USING TIME-TO-TARGET CRITERIA

FIELD OF THE INVENTION

The present subject matter relates generally to a cooking appliance and methods for operating a cooking appliance. More particularly, the present subject matter relates to cooking appliances and methods for operating cooking appliances to limit the temperature of a cooking utensil positioned on a heating source of the cooking appliance.

BACKGROUND OF THE INVENTION

Cooking appliances, such as, e.g., cooktops (also known as hobs) or ranges (also known as stoves), generally include one or more heated portions for heating or cooking food items within a cooking utensil placed on the heated portion. The heated portions utilize one or more heating sources to output heat, which is transferred to the cooking utensil and thereby to any food item or items within the cooking utensil. Typically, an electronic controller or other control mechanism, such as a thermo-mechanical electrical switch (also known as an infinite switch), regulates the heat output of the heating source selected by a user of the cooking appliance, e.g., by turning a knob or interacting with a touch-sensitive control panel. For example, the control mechanism may cycle the heating source between an activated or on state and a substantially deactivated or off state such that the average heat output approximates the user-selected heat output. This cycling action may have a period of several seconds, as is typically the case when relays are employed, or might take place on each half-cycle of an AC waveform, which is possible with semiconductor switching devices.

However, the transfer of heat to the cooking utensil and/or food items may cause the food items or cooking utensil to overheat or otherwise cause unwanted and/or unsafe conditions on the cooktop. Although the cooking appliance usually has features for regulating the heat output of the heating source as described above, setting the heat output to a high level can cause the cooking utensil, and its contents, to reach excessively high temperatures. As an example, a high heat output setting may cause a frying pan or skillet containing only a thin layer of cooking oil to quickly rise in temperature because the thermal mass of the cooking utensil and cooking oil is small. In some cases, the temperature may rise such that the cooking oil self-ignites. On the other hand, a high heat output setting typically does not lead to dangerous conditions for large food loads, e.g., a pot filled with water, because the large thermal mass slows the rate at which the cooking utensil and food heat up and, in this particular example, because water is a self-temperature-regulating compound and is not a self-igniting chemical compound. Therefore, cooking performance of the cooking appliance may be negatively impacted if the appliance regulates every use of a high heat output setting regardless of the temperature reached by the cooking utensil and/or its contents.

Accordingly, a cooking appliance with features for selectively limiting a maximum temperature reached by a cooking utensil placed on a heating source of the cooking appliance without impacting the performance of the cooking appliance during other cooking operations would be useful. Methods for operating a cooking appliance to selectively limit a maximum temperature reached by a cooking utensil placed on a heating source of the cooking appliance without impacting the performance of the cooking appliance during other cooking operations also would be beneficial. In particular, an appliance and its associated methods that limits a maximum temperature reached by a lightly-loaded cooking utensil containing highly combustible foods (e.g., cooking oil, grease, and bacon) but does not limit the heat output to a heavily-loaded cooking utensil containing non-combustible foods (e.g., water or a water-based sauce) would be advantageous.

BRIEF DESCRIPTION OF THE INVENTION

Aspects and advantages of the invention will be set forth in part in the following description, or may be obvious from the description, or may be learned through practice of the invention.

In one exemplary embodiment of the present subject matter, a method for operating a cooking appliance is provided. The method includes providing power to the heating source according to a first control mode; determining whether to transition from the first control mode to a second control mode and, if so, then providing power to the heating source according to the second control mode. The method further includes determining whether to transition from the second control mode to a third control mode and, if so, then providing power to the heating source according to the third control mode.

In a further exemplary embodiment of the present subject matter, a cooking appliance is provided. The cooking appliance includes a heating source; a temperature sensor; an energy control device for modulating the power provided to the heating source; and a controller. The temperature sensor is positioned to sense the temperature of a bottom surface of a cooking utensil when the cooking utensil is placed on or adjacent to the heating source. The controller is in operative communication with the temperature sensor and the energy control device. The controller is configured for providing power to the heating source according to a first control mode; determining whether to transition from the first control mode to a second control mode and, if so, then providing power to the heating source according to the second control mode. The controller also is configured for determining whether to transition from the second control mode to a third control mode and, if so, then providing power to the heating source according to the third control mode.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 provides a chart illustrating a method of operating a cooking appliance according to an exemplary embodiment of the present subject matter.

FIG. 5A provides a chart illustrating a portion of a method of operating a cooking appliance according to an exemplary embodiment of the present subject matter.

FIG. 5B provides a chart illustrating a portion of a method of operating a cooking appliance according to an exemplary embodiment of the present subject matter.

FIG. 5C provides a chart illustrating a portion of a method of operating a cooking appliance according to an exemplary embodiment of the present subject matter.

DETAILED DESCRIPTION OF THE INVENTION

Figure 1:
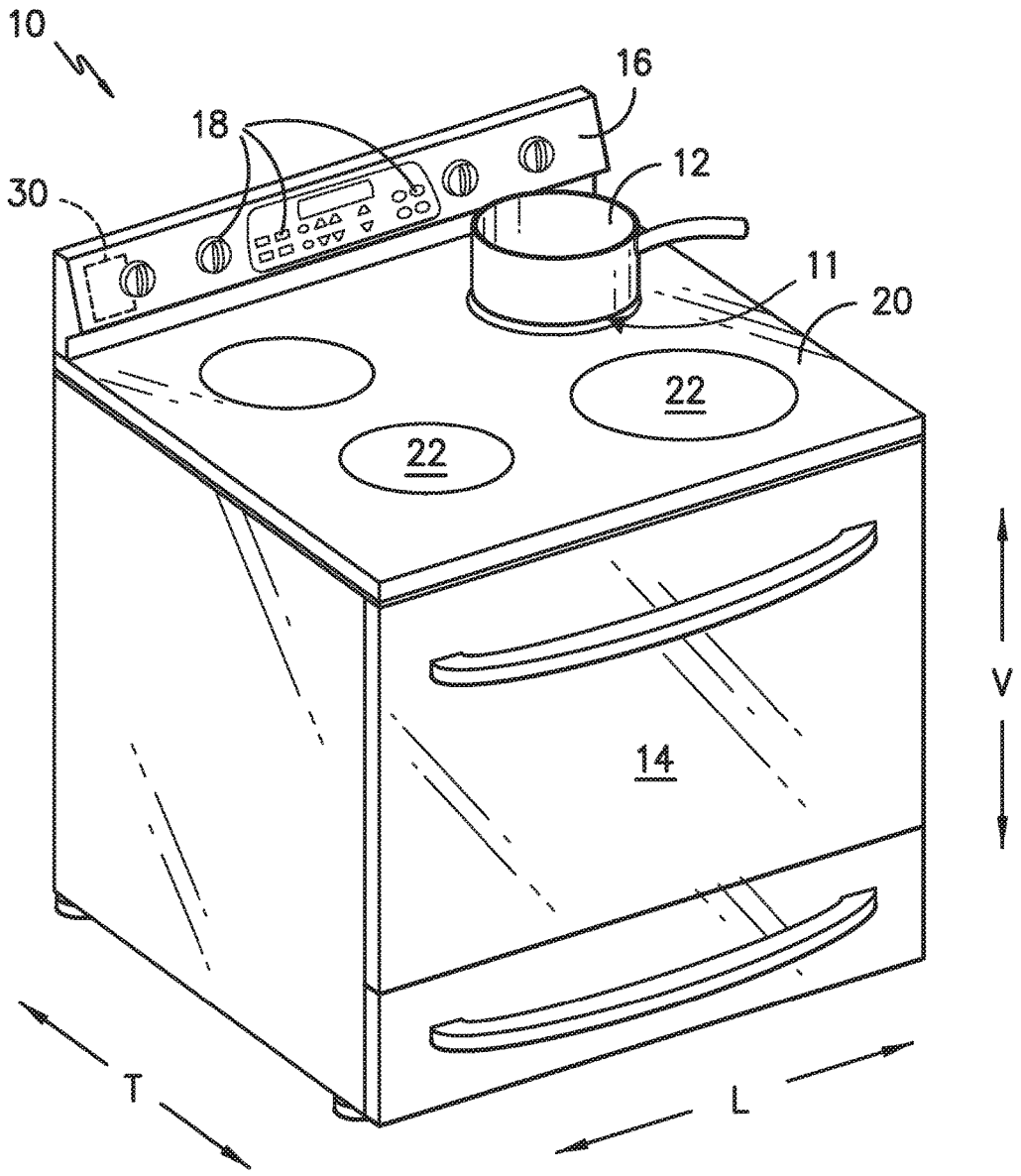
FIG. 1 provides a side, perspective view of a cooking appliance according to an exemplary embodiment of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Further, each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, wherein identical numerals indicate the same elements throughout the figures, FIG. 1 is a side, perspective view of a cooking appliance, generally referred to as a stove or range, according to an exemplary embodiment of the present subject matter. Cooking appliance 10 may be a range appliance as shown in FIG. 1, which has an oven positioned vertically below a cooktop. However, cooking appliance 10 is provided by way of example only and is not intended to limit the present subject matter in any aspect. Thus, the present subject matter may be used with other cooking appliance configurations, e.g., cooktop appliances without an oven. Further, the present subject matter may be used in any other suitable appliance.

Figure 2:
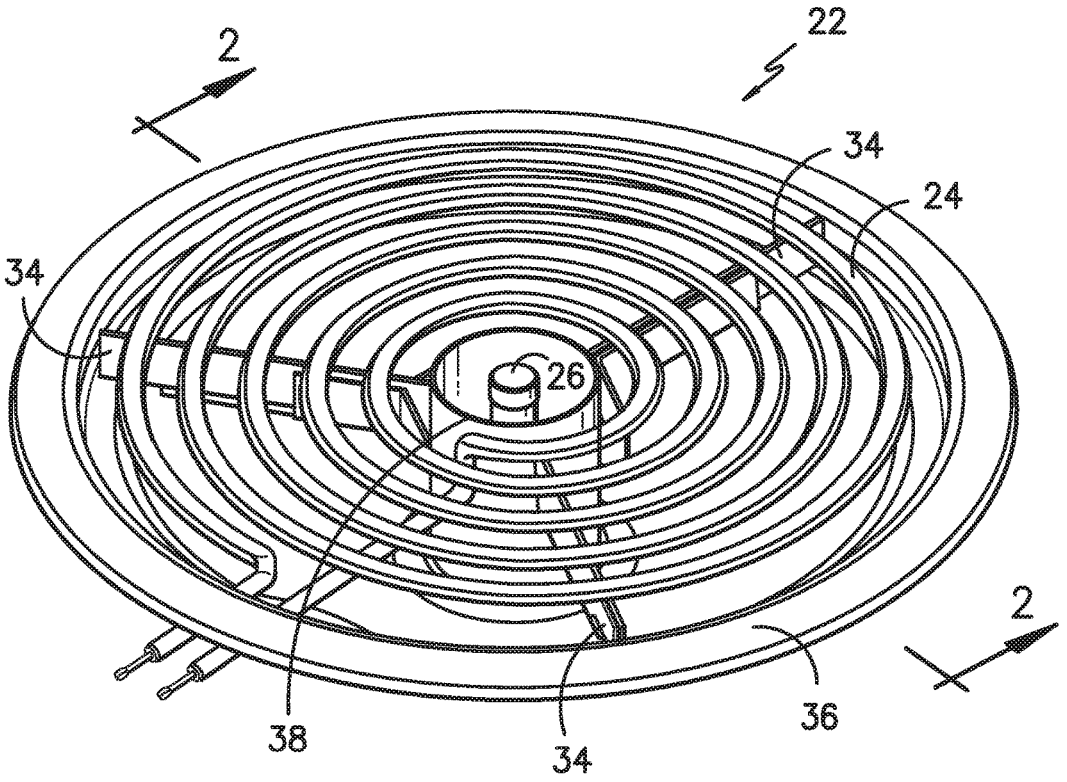
FIG. 2 provides a top, perspective view of a heating source assembly of the cooking appliance of FIG. 1 according to an exemplary embodiment of the present subject matter.
Figure 3:
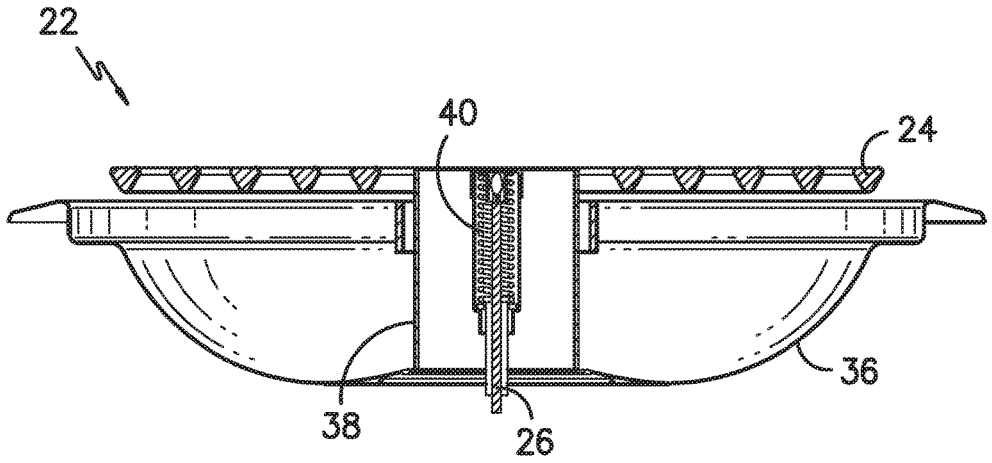
FIG. 3 provides a cross-section view of the heating source assembly of FIG. 2.

Cooking surface 20 of cooking appliance 10 includes heating source assemblies 22 having heating sources 24 (FIG. 2). Heating sources 24 may be, e.g., electrical resistive heating elements, gas burners, induction coils, and/or any other suitable heating source. In some embodiments, cooking appliance 10 may be a radiant or induction cooktop appliance, and cooking surface 20 may be an essentially solid surface constructed of a glass, ceramic, or a combination glass-ceramic material, or any other suitable material. In the exemplary embodiment as shown in FIGS. 2 and 3, the cooking appliance 10 may be an electric coil cooktop appliance, and cooking surface 20 may be constructed of a metallic material, e.g., steel or stainless steel, and the heating source assemblies 22 may utilize exposed, electrically-heated, helically-wound planar coils as heat sources 24. Each heating source assembly 22 of cooking appliance 10 may be heated by the same type of heating source 24, or cooking appliance 10 may include a combination of different types of heating sources 24. Further, heating source assemblies 22 may have any suitable shape and size, and cooking appliance 10 may include a combination of heating source assemblies 22 of different shapes and sizes.

As shown in FIG. 1, a cooking utensil 12, such as a pot, kettle, pan, skillet, or the like, may be placed on or adjacent a heating source assembly 22 to cook or heat food items placed within the cooking utensil. For example, utensil 12 may be positioned directly on heating source 24 of a cooking appliance having electrical resistive heating elements, such as electric resistance coils. As another example, utensil 12 may be placed on a grate vertically above heating source 24 when the heating source is a gas burner. As a further example, utensil 12 may be placed on a support surface, such as a glass-ceramic cooktop, for embodiments in which heating source 24 is an induction or electric radiant heating source located below the support surface. In each embodiment, utensil 12 may be positioned directly on or adjacent heating source 24 such that heating source 24 can provide heat to utensil 12 to cook or heat any food items within the utensil.

Referring still to FIG. 1, cooking appliance 10 also includes a door 14 that permits access to a cooking chamber (not shown) of appliance 10, the cooking chamber for cooking or baking of food or other items placed therein. A control panel 16 having user controls 18 permits a user to make selections for cooking of food items using heating source assemblies 22 and/or the cooking chamber. Although shown on a backsplash or back panel of cooking appliance 10, control panel 16 may be positioned in any suitable location, e.g., along a front edge of the appliance or on the cooking surface 20. Controls 18 may include buttons, knobs, and the like, as well as combinations thereof. As an example, a user may manipulate one or more user controls 18 to select, e.g., a power or heat output level for each heating source assembly 22. The selected heat output level of heating source assembly 22 affects the heat transferred to cooking utensil 12 placed on heating source assembly 22, as further described below.

The operation of cooking appliance 10, including heating sources 24, may be controlled by a processing device such as a controller 30, which may include a microprocessor or other device that is in operative communication with components of appliance 10. Controller 30 may include a memory and microprocessor, such as a general or special purpose microprocessor operable to execute programming instructions or micro-control code associated with a cleaning cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 30 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 18 and other components of cooking appliance 10 may be in communication with controller 30 via one or more signal lines or shared communication busses.

In some embodiments, one or more components of cooking appliance 10 may be controlled independent of controller 30. For example, the heat output of heating source 24 may be controlled by a mechanical, electromechanical, or thermo-electro-mechanical control mechanism, such as, e.g., an infinite switch. In other embodiments, a combination of controller 30 and one or more other control mechanisms may be used to control the features of cooking appliance 10. As an example, controller 30 may control the heat output of heating source 24 during one or more operating modes of appliance 10 and another control mechanism, such as the infinite switch, may control the heat output during other operating modes of appliance 10.

FIG. 2 provides a top, perspective view of a heating source assembly 22 according to an exemplary embodiment of the present subject matter. In the illustrated exemplary embodiment, heating source 24 is a spiral shaped electrical resistive heating element; that is, FIG. 2 illustrates a heating source assembly 22 for an electric coil cooking appliance. Cooking utensils 12 are placed directly on heating source 24 of the illustrated cooking appliance 10. As shown, heating source 24 may be supported by one or more support elements 34, which also help support cooking utensil 12 when placed on heating source 24. Moreover, in the depicted embodiment, a temperature sensor 26 is positioned approximately in the center of heating source assembly 22. Temperature sensor 26 may be used, e.g., to measure the temperature of a cooking utensil 12 placed on the respective heating source assembly 22 and provide such temperature measurements to controller 30. As such, temperature sensor 26 may be a resistive temperature device (RTD), a thermistor, a thermocouple (TC), or any other appropriate temperature sensing device.

In the depicted embodiment, temperature sensor 26 is positioned such that sensor 26 contacts a bottom surface 11 of cooking utensil 12 (FIG. 1) when cooking utensil 12 is placed on heating source 24 of assembly 22. More particularly, a sensing element 27 (FIG. 3) of temperature sensor 26 contacts a bottom surface 11 of cooking utensil 12 in configurations of cooking appliance 10 using, e.g., electric resistance heating elements or gas burners as heating sources 24. Sensing element 27 may directly contact bottom surface 11 or may indirectly contact bottom surface 11, e.g., a top portion of sensor 26 may directly contact bottom surface 11 and sensing element 27 may directly contact the top portion of sensor 26. In other embodiments of appliance 10, such as cooking appliances utilizing electric radiant heating elements or induction heating elements as heating sources 24, sensing element 27 may be positioned to contact an underside of a support surface of appliance 10 adjacent the bottom surface 11 of a cooking utensil 12 placed on the support surface. Sensing element 27 may directly contact the underside of the support surface or may indirectly contact the underside of the support surface, e.g., a top portion of sensor 26 may directly contact the underside and sensing element 27 may directly contact the top portion of sensor 26. Positioning temperature sensor 26 approximately in the center of heating source assembly 22 may help ensure that temperature sensor 26 contacts a cooking utensil 12 placed on heating source 24 no matter the size or shape of utensil 12. However, sensor 26 may be positioned in any suitable location within the heating source assembly 22.

FIG. 3 provides a cross-section view of heating source assembly 22 shown in FIG. 2. As illustrated, heating source assembly 22 may have a generally semi-circular cross-section, but in other embodiments, heating source assembly 22 may have other cross-sectional shapes. In the depicted embodiment, heating source assembly 22 includes a drip pan 36 positioned below heating source 24 along the vertical direction V. Drip pan 36 may help collect any spills, boil-overs, or other debris from cooking activities or other uses of cooking appliance 10. Further, as most clearly shown in FIG. 2, a heat shield 38 extends circumferentially about temperature sensor 26. Heat shield 38 may be provided to minimize convective airflow and/or deflect or reflect radiation of heat from heating source 24 to sensor 26, which could negatively impact the temperature readings or measurements of sensor 26, e.g., by artificially elevating the temperature sensed by temperature sensor 26. As shown, heat shield 38 may be generally cylindrical in shape, but other shapes may be used as well. In some embodiments, heat shield 38 may be omitted. Further, although FIG. 3 depicts heat shield 38 being connected to, or a part of, drip pan 36, other configurations may be used as well. For example, heat shield 38 could extend through an opening in a bottom surface of drip pan 36 and be attached to another portion of the appliance, such as a chassis of the appliance, or heat shield 38 could be attached directly to the support elements 34 beneath the heating source 24.

Preferably, temperature sensor 26 is a spring-loaded sensor as depicted in FIG. 3. Spring-loaded temperature sensor 26 includes a spring 40 that helps position sensing element 27 in contact with or immediately adjacent bottom surface 11 of cooking utensil 12 positioned on or adjacent heating source 24. Further, spring 40 assists in keeping temperature sensing element 27 in contact with bottom surface 11, or the surface supporting utensil 12, while utensil 12 remains on heating source 24. Keeping sensing element 27 in contact with bottom surface 11 or the support surface facilitates more accurate measurements of the temperature of cooking utensil 12. Improving accuracy in measuring the temperature of cooking utensil 12 helps controller 30 better control the power provided to heating source 24, e.g., to ensure cooking utensil 12, and/or food items within utensil 12 do not exceed a maximum temperature. Of course, temperature sensor 26 may have other configurations appropriate for measuring the temperature of cooking utensil 12 positioned on heating source 24 and/or the temperature of food items placed within cooking utensil 12.

Figure 4A:
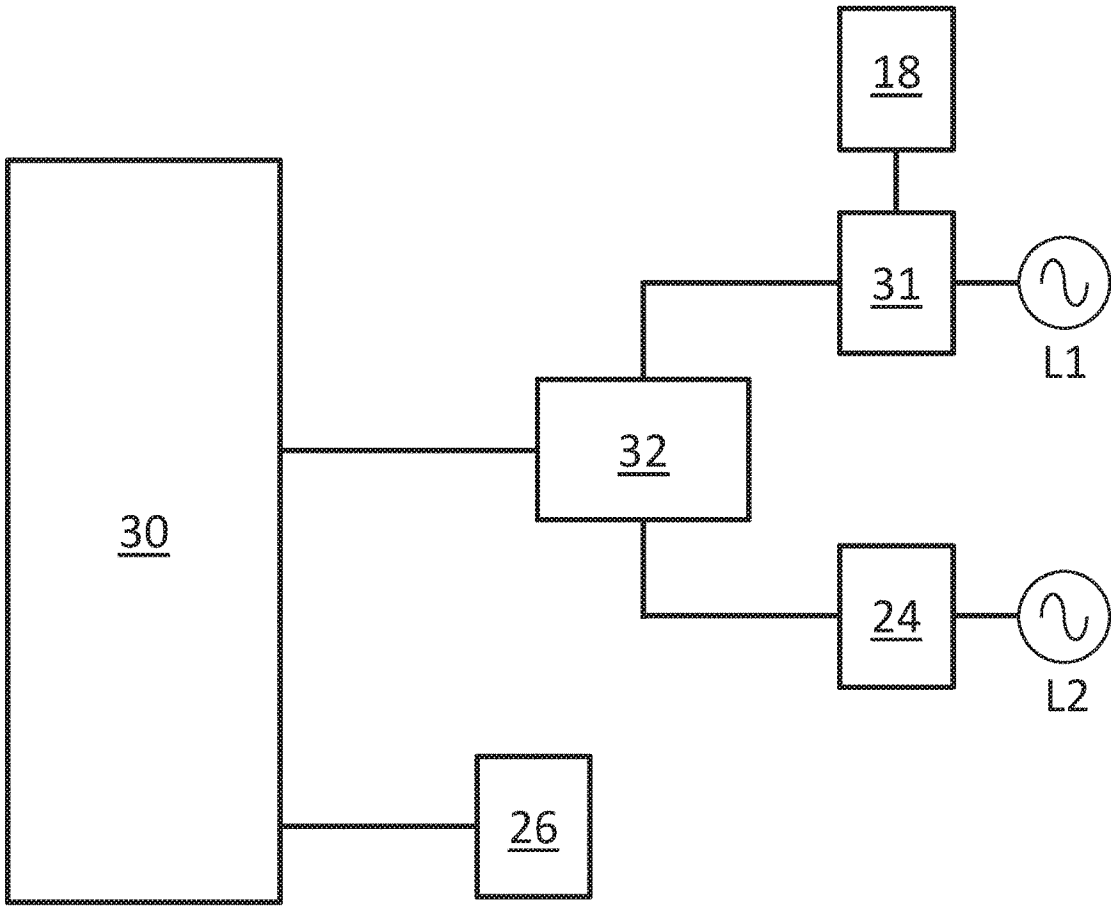
FIG. 4A provides a schematic diagram of a portion of the cooking appliance of FIG. 1.
Figure 4B:
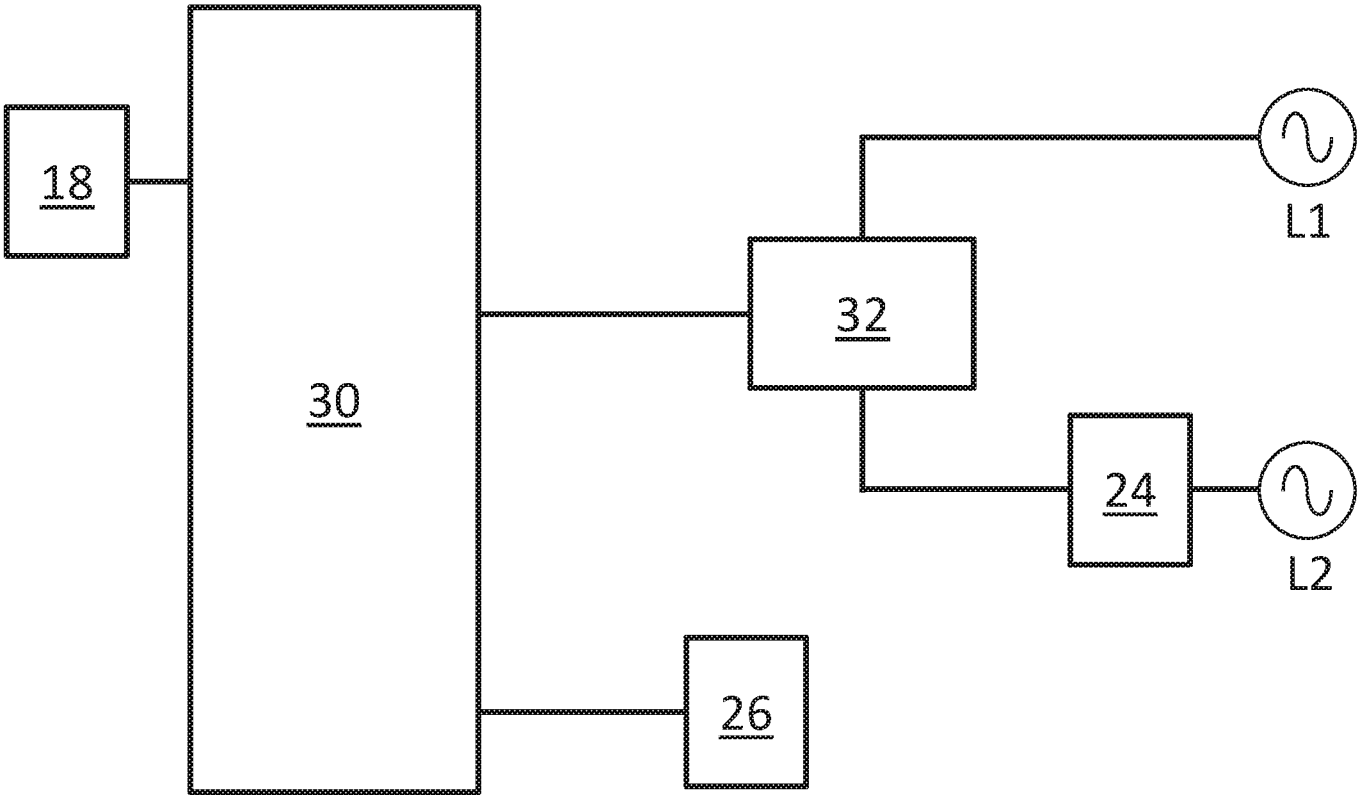
FIG. 4B provides another schematic diagram of a portion of the cooking appliance of FIG. 1.

Referring now to FIGS. 4A and 4B, schematic diagrams of a portion of cooking appliance 10 are provided. As stated, controller 30 may be in operative communication with various components of cooking appliance 10, e.g., heating sources 24 and user controls 18, such that, in response to user manipulation of user controls 18, controller 30 operates the various components of cooking appliance 10 to execute selected cycles and control various features of appliance 10. Controller 30 may also be in communication with temperature sensor 26 and an energy control device 32. Using the measurements provided by temperature sensor 26, controller 30 may control the power provided to heating source 24 to regulate or modulate the heat output of heating source assembly 22, e.g., to a heat output level or desired cooking temperature selected by the user by means of user control 18 or to keep the temperature of cooking utensil 12 below a predetermined maximum temperature. As an example, if heating source 24 is an electric heating source, controller 30 may be in operative communication with an energy control device 32 that interrupts the flow of current from a power source (not shown) to control the current provided to heating source 24 and thereby control the heat output of heating source 24. In such embodiments, device 32 may be an electromechanical device such as a relay or a solid-state device, e.g., a TRIAC (triode for alternating current) or the like. As another example, if heating source 24 is a gas heating source, controller 30 may be in operative communication with an energy control device 32 to control a flow of gas to heating source 24 and thereby control the heat output of heating source 24. In such embodiments, device 32 may be, e.g., an electronically controlled valve, a device for controlling a valve, or any other device that meters the flow of gas to heating source 24. Device 32 may, for example, reduce a size of a passageway for the flow of gas such that flames produced by heating source 24 are reduced, which in turn reduces the heat output of heating source 24. In other embodiments, device 32 may have other appropriate configurations for interrupting, reducing, or otherwise controlling the power provided to heating source 24 to control an amount of heat produced by heating source 24.

In some embodiments, as shown in FIG. 4A, user controls 18 may include or be in operative communication with a thermo-electro-mechanical switch, e.g., an infinite switch, or other mechanical device 31, e.g., a manual gas control valve, to control the heat output of heating source 24. For example, a user control such as a knob 18 may control a mechanical, electromechanical, or thermo-electro-mechanical device 31 (referred to generally herein as "mechanical device 31"), such as a bi-metal infinite switch. Mechanical device 31 may modulate the duty cycle of heating source 24, e.g., by opening or closing internal electrical contacts to regulate the duty cycle (i.e., the amount of time heating source 24 is on/off during a periodic switching cycle) based on the user input via control 18. In this embodiment, energy control device 32 may be used solely to substantially deactivate heating source 24 when controller 30 establishes that an unsafe situation exists, e.g., if the temperature of cooking utensil 12 sensed by temperature sensor 26 is exceeding or approaching a predefined temperature limit. In many instances, for example, when cooking a large water-based food item (such as boiling pasta in water), heating source 24 is controlled only by the mechanical device 31, and controller 30 never deactivates the heating source 24 using energy control device 32. As further described below, controller 30 may include temperature limiting software that deactivates heating source 24 using energy control device 32 only when temperature sensor 26 indicates an unsafe operating condition exists (or is soon to exist), as would generally be likely to occur when heating a skillet with a thin layer of cooking oil but not when heating a large water-based food item.

Because they are wired in series with the heat source 24, mechanical device 31 and energy control device 32 may each cause a pulse width modulation ("PWM") of the power provided to heating source 24 to regulate the heat output of the heating source. In general, heating source 24 is fully controlled via the mechanical device 31, which regulates the output heat level of heating source 24 according to a user's input via user control 18. As such, heating source 24 usually is controlled via energy control device 32 only in the case of an unsafe cooking condition; that is, when an unsafe condition is detected, PWM by the mechanical device 31 is overridden by the temperature limiting algorithm described below such that the energy control device 32 causes the PWM of power provided to heating source 24.

In other embodiments, as shown in FIG. 4B, user controls 18 may include or be in operative communication with a touch-sensitive control area 18 where the user may select a heat output level of a heating source 24 by touching the touch-sensitive control area. The touch-sensitive control area 18 is in communication with controller 30 to regulate or modulate the heat output level of heating source 24, e.g., by controlling the duty cycle of the heating source via energy control device 32 based on a typical control algorithm that relates the duty cycle to the user-selected heat output level. In this embodiment, energy control device 32 serves to control heating source 24 based on both the typical control algorithm and a safety control algorithm, or temperature limiting algorithm, further described below. Thus, energy control device 32 using a typical control algorithm, which relates the user setting to a heat output level, is the primary control of the heating source 24, rather than the mechanical device 31 described with respect to FIG. 4A. However, in the embodiment of FIG. 4B, controller 30 may include temperature limiting software that deactivates heating source 24 using energy control device 32 when temperature sensor 26 indicates an unsafe operating condition exists (or is soon to exist). That is, like the embodiment of FIG. 4A, controller 30 may include temperature limiting software that overrides the typical control algorithm to modulate the heat output level of heating source 24 according to a safety or temperature limiting control algorithm when an unsafe cooking condition is detected.

Accordingly, unlike embodiments having a mechanical device 31 as illustrated in FIG. 4A, embodiments of appliance 10 incorporating touch-sensitive or other electronic controls 18 utilize software to control heating sources 24 based on both the user-selected heating level and the preset temperature limiting feature. That is, in embodiments such as the embodiment of FIG. 4B, software replaces the behavior of mechanical device 31, and controller 30 produces a single signal to control energy control device 32 for both "normal" user-selected operation and "safety" temperature-limiting operation. For example, controller 30 may control device 32 to cycle heating source 24 between an "on" state and an "off" state during a given period, e.g., a relatively short time period such as 20 seconds, such that the average temperature or heat output over each cycle approximates the user-selected temperature or heat output level, respectively. That is, controller 30 may control the duty cycle of heating source 24 such that, based on the user's temperature or heat level selection via user control 18 and the temperature sensed by temperature sensor 26, controller 30 turns on heating source 24 for a fraction or portion of the duty cycle and turns off heating source 24 for the remainder of the duty cycle. In contrast, for cooking appliances 10 incorporating mechanical device 31, a user may, e.g., manipulate a user control 18 associated with a heating source 24 to select a desired heat output level for the heating source. The selection by the user controls what fraction or portion of the duty cycle heating source 24 should be on, e.g., if the user selects a midpoint heat output level, mechanical device 31 may control the duty cycle of heating source 24 such that heating source 24 is on for half of the duty cycle and off for half of the duty cycle. As another example, if the user selects the highest heat output level, mechanical device 31 may control the duty cycle such that heating source is in the on state over the entire period or cycle. In still other embodiments, the power provided to heating source 24 may be controlled in other ways. For example, where cooking appliance 10 utilizes gas burners as heating sources 24, a valve may be cycled between fully open, partially open, and substantially closed to modulate the power, i.e., gas, provided to gas heating source 24 and thereby control the heat output of heating source 24. In such embodiments, as valve is cycled such that a flow of gas therethrough is restricted, the valve may not be fully closed such that the gas burner does not require re-ignition during cycles of heating source 24.

As further described below, one or more methods may be used to limit a maximum temperature of cooking utensil 12 to prevent unsafe conditions of cooking appliance 10. In such methods, if cooking utensil 12 approaches a potentially unsafe temperature, controller 30 may be configured to utilize energy control device 32 to regulate or modulate the duty cycle of heating source 24 such that the average heat output over the duty cycle is a fraction of the user's selected heat output level. In an example embodiment, such a temperature limiting system may include three operating modes—a first control mode, a second control mode, and a third control mode. In the first control mode, a power level of heating source 24 may be regulated such that the power level approximates a user-selected power level. However, in the first control mode, a control device such as controller 30 may also monitor the temperature and/or rate of temperature change of a cooking utensil 12 positioned on the heating source 24 to determine whether to regulate the power level according to the second control mode. That is, if the control device determines heating of utensil 12 is approaching an unsafe condition, the control device may transition to the second control mode. In the second control mode, the power level of heating source 24 may go to essentially zero to allow dissipation of the thermal energy of the cooking utensil 12 and any food items therein, as well as to allow the temperature of the utensil and its contents to stabilize. After the power level has been essentially zero for a period of time, the power level of heating source 24 may be regulated in the third control mode, which controls the temperature of utensil 12 to a predetermined temperature limit. Of course, when operating in the second or third control modes, the temperature limiting system also include features for determining whether to transition back to the first control mode rather than continuing to operate in the current control mode or transitioning to the next control mode.

FIG. 5 provides a chart illustrating a method for operating a cooking appliance, such as cooking appliance 10, according to an exemplary embodiment of the present subject matter. Although one or more portions of method 500 may be described below as performed by controller 30, it should be appreciated that method 500 may be performed in whole or in part by controller 30 or any other suitable device or devices.

At step 502, heating source 24 is activated at a user selected heat output level. For example, controller 30 may detect a touch input to a touch-type control 18 or the user may manipulate of a knob, button, or other mechanical control 18 to input a power or heat level for heating source 24. Typical heat output levels of cooking appliances range from "LOW," e.g., the lowest or least heat output of a heating source 24, to "HIGH," e.g., the highest or greatest heat output of heating source 24. Other heat output levels, e.g., medium-low ("MED-LOW"), medium ("MED"), medium-high ("MED-HI"), and the like between the lowest and the highest levels also may be selectable. Thus, at step 502, heating source 24 may be activated according to a user input (LOW, MED, HIGH, etc.), i.e., according to a heat output level selected by the user, such that power (e.g., electric current or gas) is provided to heating source 24 to enable heating source 24 to provide heat at the selected heat output level.

Next, at step 504, power is provided to heating source 24 according to a first control mode M1. That is, for the particular heating source 24 activated at the user selected power level at step 502, a power level $P_{HS}$ is provided to the heating source to produce a heat output based on the power level input, i.e., based on the user selected power level. In an exemplary embodiment in which the user manipulates a touch-type control 18 to select a power level, controller 30 controls the duty cycle of heating source 24, as described above, to provide power at the power level $P_{HS}$ established by a first control mode M1. The first control mode M1 establishes the power level $P_{HS}$ as a power level determined by a formula or look-up table that corresponds to the user setting or user selected power level. That is, the first control mode M1 essentially regulates the power $P_{HS}$ of heating source 24 according to traditional methods for operating electronically-controlled heat sources in an electric cooktop. For example, in some embodiments, the power level PHS in the first control mode M1 is regulated through PWM of energy control device 32 at some predetermined rate (e.g., a period of 20 seconds). In another exemplary embodiment in which mechanical device 31 responds to manipulation of user control(s) 18 to regulate the power level of heating source 24, mechanical device 31 controls the duty cycle of heating source 24, as described above, to provide power at the power level $P_{HS}$ established by the first control mode M1. In such embodiments, controller 30 deactivates energy control device 32 and allows mechanical device 31 to control the power level $P_{HS}$ of heating source 24. An exemplary embodiment of the first control mode M1 is shown in FIG. 5A and described in greater detail below.

A cooking utensil 12 may be positioned on heating source 24, and as heating source 24 outputs heat, the cooking utensil 12 and any food items therein begin to warm. Controller 30 may monitor a temperature $T_{sensed}$ of cooking utensil 12, e.g., by using temperature sensor 26 as described above. If the cooking temperature $T_{sensed}$ begins to rise at a rapid rate, such that controller 30 calculates the cooking utensil temperature $T_{sensed}$ will reach a target temperature limit $T_{limit}$ within a certain time period, controller 30 may determine that the power $P_{HS}$ provided to heating source 24 should be modulated differently than the power $P_{HS}$ is modulated in the first control mode M1. As such, method 500 may further include step 506 of determining whether to transition from the first control mode M1 to a second control mode M2. If so, then controller 30 provides power $P_{HS}$ to heating source 24 according to the second control mode M2, as shown at step 508. However, if at step 506 controller 30 determines not to transition to the second control mode M2, then controller 30 continues to provide power $P_{HS}$ to heating source 24 according to the first control mode M1.

The second control mode M2 may include reducing the power $P_{HS}$ provided to heating source 24 to a minimum power level $P_{min}$, i.e., essentially disabling heating source 24 for a period of time to halt the input or delivery of heat to cooking utensil 12. Thus, the second control mode M2 essentially deactivates heating source 24 such that the residual thermal energy (i.e., heat) within the heating source may be dissipated into cooking utensil 12, allowing the heating of the utensil (and any food therein) to diminish and the temperature to stabilize; ideally, the temperature stabilizes at or below the target temperature limit $T_{limit}$. An exemplary embodiment of the second control mode M2 is shown in FIG. 5B and described in greater detail below.

Next, as shown at step 510 in FIG. 5, controller 30 may determine whether to transition from the second control mode M2 to a third control mode M3. If controller 30 determines not to transition to the third control mode M3, then method 500 includes step 512, where controller 30 determines whether to transition back to the first control mode M1. If so, then method 500 returns to step 504 and controller 30 provides power $P_{HS}$ to heating source 24 according to the first control mode M1. However, if controller 30 determines at step 512 not to transition back to the first control mode M1, controller 30 continues to provide power $P_{HS}$ to heating source 24 according to the second control mode M2.

As shown as step 514, if controller 30 determines to transition to the third control mode M3, power $P_{HS}$ is provided to heating source 24 according to the third control mode M3. In the third control mode, the power level $P_{HS}$ of heating source 24 is modulated as follows to help prevent cooking utensil 12 and/or any food items therein from overheating:

$$I=I+(K_i*T_{err})$$

$$P_{HS}=(K_p*T_{err})+1$$

where $$T_{err}=T_{limit}-T_{sensed}$$

In the third control mode M3, controller 30 may use energy control device 32 to control the duty cycle of heating source 24 and thereby control the power $P_{HS}$ provided to heating source 24.

As shown, the third control mode M3 may utilize a proportional-integral (PI) or proportional-integral-derivative (PID) control algorithm; a PI control implementation is detailed herein. The PI control algorithm utilizes a temperature error $T_{err}$ to determine the power $P_{HS}$ provided to heating source 24. The temperature error $T_{err}$ is the difference between the cooking utensil temperature $T_{sensed}$ measured or sensed by temperature sensor 26, which preferably is contact with bottom surface 11 of cooking utensil 12 as described above, and the target temperature limit $T_{limit}$. The target temperature limit $T_{limit}$ is a predetermined temperature to which controller 30, using method 500, regulates the temperature of cooking utensil 12 to help prevent undesirable conditions that may occur as heat is provided to cooking utensil 12 and any food items within utensil 12. In some embodiments, the measured or sensed temperature $T_{sensed}$ may be noise filtered to reduce the effects of spikes or irregularities in the measured values. Any appropriate noise filter may be used, such as, e.g., a moving average filter, a lag filter, or the like.

Further, the PI control utilizes a proportional gain factor $K_p$, an integral gain factor $K_i$, and an integrated temperature error term I to determine the power $P_{HS}$ provided to heating source 24. The proportional gain factor $K_p$ and integral gain factor $K_i$ may be predetermined and programmed into controller 30. For example, the proportional gain factor $K_p$ and the integral gain factor $K_i$ may be determined based on a specific system, e.g., based on a mass and power density of heating source 24 and/or a diameter, mass, and specific heat of cooking utensils 12 likely to be used with a particular cooking appliance 10. As such, the proportional gain factor $K_p$ and the integral gain factor $K_i$ used in the above PI control algorithm may vary from one embodiment to another of method 500. The integral term I may be established as a typical PI control integral term would be established, i.e., its value during each execution loop may be increased or decreased based on the calculated temperature error $T_{err}$.

Next, as shown at step 516, controller 30 may determine whether to transition from the third control mode M3 to the first control mode M1. If so, method 500 returns to step 504, and controller 30 provides power $P_{HS}$ to heating source 24 according to the first control mode M1. If controller 30 determines not to transition back to the first control mode, controller 30 continues to provide power to heating source 24 according to the third control mode M3. An exemplary embodiment of the third control mode M3 is shown in FIG. 5C and described in greater detail below.

As previously stated, FIG. 5A provides a chart illustrating an exemplary embodiment of the first control mode M1, i.e., a chart illustrating a portion of method 500 according to an exemplary embodiment of the present subject matter. As described, at step 504, controller 30 provides power to heating source 24 based on the power level input by the user. In various embodiments, mechanical device 31 or controller 30/energy control device 32 may regulate the duty cycle of heating source 24 to provide power $P_{HS}$ at the user selected power level as described above. First control mode M1 also includes step 506*a* of calculating a rate of change ΔT of the temperature $T_{sensed}$ of a cooking utensil 12 positioned or placed on heating source 24, i.e., controller 30 may calculate the slope of the cooking utensil temperature $T_{sensed}$ over a period of time X The cooking utensil temperature $T_{sensed}$ may be measured on a periodic basis, e.g., once per second. In one embodiment, controller 30 stores the values of the cooking utensil temperature $T_{sensed}$ over the period of time X. Then, the rate of change ΔT of the temperature $T_{sensed}$ over the period of time X may be calculated as $$\Delta T = \frac{T_{sensed}(0) - T_{sensed}(X)}{X}$$

where $T_{sensed}(\mathbf{0})$ is the current temperature and $T_{sensed}(X)$ is the temperature measured or sensed X seconds ago. It will be appreciated that either or both of the temperature $T_{sensed}$ and rate of change ΔT may be noise filtered as described above, e.g., using a moving average, lag, or other appropriate filter. Also, it will be appreciated that an electrically-heated cooking system (e.g., an electric coil or electric radiant cooking appliance 10) may have a relatively large thermal inertia because cooking utensil 12 and any food therein, as well as heating element 24, must be heated. As such, the rate of change ΔT of the cooking utensil temperature $T_{sensed}$ will be relatively slow. Thus, in embodiments in which heating assembly 22 is an electric heating assembly, the time interval X should be fairly long or large, i.e., to accurately calculate the rate of temperature change ΔT, the temperature $T_{sensed}$ should sampled over a fairly long time interval X, e.g., 10 seconds. Conversely, in embodiments in which heating assembly 22 is a gas-heated or induction heating assembly, where the heating source 24 typically does not have to heat up to provide heat to cooking utensil 12, the thermal inertia is relatively small such that the time interval X can be shorter, e.g., 3 seconds. Of course, other values of the time interval X may be used as well.

The first control mode M1 illustrated in FIG. 5A further includes step 506*b* of calculating a time interval $t_{limit}$ for the cooking utensil temperature $T_{sensed}$ to reach a target temperature limit $T_{limit}$, time interval $t_{limit}$ may be referred to as a time-to-target calculation and is essentially the inverse of a linear extrapolation of the temperature over a future time interval. The time-to-target calculation estimates the time interval it will take cooking utensil 12 to reach the target temperature limit $T_{limit}$ given the current temperature $T_{sensed}$ (0) and the rate at which the temperature is changing, i.e., the rate of temperature change ΔT. As previously described, the target temperature limit $T_{limit}$ may be an upper limit of the temperature controller 30 allows cooking utensil 12 to reach. That is, the target temperature limit $T_{limit}$ is a predetermined temperature to which controller 30, using method 500, regulates the temperature of cooking utensil 12 to help prevent undesirable conditions that may occur as heat is provided to cooking utensil 12 and any food items within utensil 12. The time interval $t_{limit}$ for cooking utensil 12 to reach target temperature limit $T_{limit}$ may be calculated as the difference between the target temperature limit $T_{limit}$ and the current cooking utensil temperature $T_{sensed}$, divided by the rate of change ΔT of the cooking utensil temperature $T_{sensed}$:

$$t_{limit} = \frac{T_{limit} - T_{sensed}(0)}{\Delta T}$$

As with the cooking utensil temperature $T_{sensed}$ and the rate of change ΔT of the temperature $T_{sensed}$, the time interval $t_{limit}$ optionally may be noise filtered to prevent an unnecessary transition from the first control mode M1 to the second control mode M2, where the power provided to heating source 24 is reduced such that the power level $P_{HS}$ is zero or near zero. Stated differently, noise filtering the time interval $t_{limit}$ may help prevent false reductions of the power $P_{HS}$ provided to heating source 24.

After calculating the time to target, controller 30 determines if the time interval $t_{limit}$ to reach target temperature limit $T_{limit}$ is less than or equal to a predetermined time interval limit $t_{turn_off}$, as shown at step 506*c*. If so, method 500 transitions to the second control mode M2 and power is provided to heating source 24 according to the second control mode M2, as illustrated at step 508. However, if the time interval $t_{limit}$ is greater than the predetermined time interval limit $t_{turn_off}$, controller 30 determines whether the cooking utensil temperature $T_{sensed}$ is at least equal to the target temperature limit $T_{limit}$, as shown at step 506*d*. If so, method 500 proceeds to step 508 and controller 30 provides power $P_{HS}$ to heating source 24 according to the second control mode M2. If not, controller 30 continues to provide power $P_{HS}$ to heating source 24 according to the first control mode M1. Optionally, method 500 also may include a check, whereby if the time interval $t_{limit}$ is less than or equal to the predetermined time interval limit $t_{turn_off}$, controller 30 determines if the cooking utensil temperature $T_{sensed}$ is at least equal to an enabling threshold temperature $T_{thr}$ before transitioning to the second control mode M2 and step 508. The enabling threshold temperature $T_{thr}$ may be somewhat less than the target temperature limit $T_{limit}$ but close enough to the temperature limit $T_{limit}$ that it may be desirable to regulate the power $P_{HS}$ according to the second control mode M2.

Thus, in the first control mode M1, controller 30 evaluates how quickly cooking utensil 12 is expected to reach the target temperature limit $T_{limit}$. The predetermined time interval limit $t_{turn_off}$ is selected as a threshold value; if controller 30 calculates it should take time interval $t_{turn_off}$, or less than the time interval $t_{turn_off}$, to reach the target temperature limit $T_{limit}$, then it is likely that cooking utensil 12 will soon reach the target temperature limit $T_{limit}$. If so, controller 30 may determine that the power to heating source 24 should be substantially reduced, i.e., the power to heating source 24 should be regulated according to the second control mode M2, to avoid cooking utensil 12 reaching undesirably high temperatures, which can lead to unsafe conditions of cooking appliance 10. As such, the predetermined time interval limit $t_{turn_off}$ preferably is selected such that the power to heating source 24 may be reduced to a minimum power level $P_{min}$ before cooking utensil 12 reaches an undesirably high temperature but is not reduced during routine cooking operations, such as boiling a pot of water. Prematurely reducing the power level $P_{HS}$ to the minimum power level $P_{min}$, when there is a minimal or no threat to the safety of the user, cooking appliance 10, and the user's surroundings, could be a nuisance to the user. Typical values of time interval limit $t_{turn_off}$ may be between 70 and 100 seconds, but other values may be used as well. The value of $t_{turn_off}$ may be determined by experimental testing of heating source 24 and a variety of empty utensils 12 to determine how long the temperature of the utensil $T_{sensed}$ will continue to rise after a power reduction, such that time interval $t_{turn_off}$ may be set to a value whereby the worst-case scenario (i.e., the longest continuation of temperature rise) will not overshoot the target temperature limit when the power $P_{HS}$ is reduced.

Referring now to FIG. 5B, a chart is provided illustrating an exemplary embodiment of the second control mode M2, i.e., a chart illustrating another portion of method 500 according to an exemplary embodiment of the present subject matter. As shown in FIG. 5B, in the second control mode M2 controller 30 reduces the power $P_{HS}$ provided to heating source 24 for a period of time $t_{off}$, i.e., at step 510*a*, power is reduced to heating source 24 such that the power level is a minimum power level $P_{min}$. The minimum power level $P_{min}$, may approximate an off or disabled condition of heating source 24. Stated differently, if power is provided to heating source 24 at the minimum power level $P_{min}$, the power provided to heating source 24 is such that heating source 24 essentially is disabled or provided a negligible level of power. In some embodiments, the minimum power level $P_{min}$ may be about 10% of the available power and, for example, the duty cycle of heating source 24 may be modulated such that the heating source is on for 10% of the duty cycle and off for the remaining 90% of its duty cycle. In other embodiments, the minimum power level $P_{min}$ may be about 5% or less. Other values of the minimum power level $P_{min}$ may be used as well.

Because of the thermal inertia of heating source 24, the cooking utensil temperature $T_{sensed}$ will continue to rise after controller 30 reduces the power level $P_{HS}$ to the minimum power level $P_{min}$. Method 500 includes waiting a period of time $t_{off}$, but not longer than a threshold time interval $t_{thr}$, for the thermal inertia of heating source 24 to dissipate. As shown at step 510*b*, controller 30 increments a timer, which is monitoring the time interval $t_{off}$ the power $P_{HS}$ provided to heating source 24 has been reduced to the minimum power level $P_{min}$. Incrementing the timer generally may be represented as $$t_{off} = t_{off} + 1$$

such that the current value of $t_{off}$ is incrementally increased at a fixed rate over the previous value of time interval $t_{off}$. Of course, in other embodiments, the time interval $t_{off}$ may be incremented in a non-linear or at a non-fixed rate.

After the timer is incremented, controller 30 determines at step 510*c* if the time interval $t_{off}$ has surpassed the threshold time interval $t_{thr}$. If so, method 500 proceeds to step 514, where controller 30 provides power to heating source 24 according to the third control mode M3. Optionally, method 500 may include determining if the cooking utensil temperature $T_{sensed}$ is at least equal to the target temperature limit $T_{limit}$ before transitioning to the third control mode M3 at step 514.

However, if at step 510*c* the time interval $t_{off}$ is not greater than the threshold time $t_{thr}$, method 500 proceeds to step 512, and controller 30 determines whether to transition back to the first control mode M1. Controller 30 may determine whether to transition back to the first control mode M1 by comparing the temperature $T_{sensed}$ of cooking utensil 12 to a disabling threshold temperature $T_{resume}$. If the cooking utensil temperature $T_{sensed}$ is at or below the disabling threshold temperature $T_{resume}$, controller 30 may determine to transition back to step 504 and provide power to heating source 24 according to the first control mode M1. Transitioning back to providing power according to the first control mode M1 also may include resetting the time interval $t_{off}$ of the timer, i.e., setting timer $t_{off}$ to zero such that the timer is initialized at zero for any future iterations of the second control mode M2. However, if the cooking utensil temperature $T_{sensed}$ is greater than the disabling threshold temperature $T_{resume}$, controller 30 may determine not to transition to the first control mode M1 such that controller 30 continues to provide power $P_{HS}$ to heating source 24 according to the second control mode M2.

FIG. 5C provides a chart illustrating an exemplary embodiment of the third control mode M3, i.e., a chart illustrating another portion of method 500 according to an exemplary embodiment of the present subject matter. As previously described, in the third control mode, controller 30 provides power $P_{HS}$ to heating source 24 based on a control algorithm, which may include modulating the duty cycle of heating source 24 to provide power $P_{HS}$ to heating source 24 according to the proportional-integral control algorithm provided above, i.e.:

$$P_{HS}=(K_p*T_{err})+1$$

FIG. 5C illustrates that, at step 516, controller 30 may determine whether to transition from the third control mode M3 to the first control mode M1 by comparing the cooking utensil temperature $T_{sensed}$ to the disabling threshold temperature $T_{resume}$. For example, if the cooking utensil temperature $T_{sensed}$ is less than or equal to the disabling threshold temperature $T_{resume}$, controller 30 may return to step 504 and provide power to heating source 24 according to the first control mode M1. Transitioning back to providing power according to the first control mode M1 also may include resetting the time interval $t_{off}$ of the timer, i.e., setting timer $t_{off}$ to zero such that the timer is initialized at zero for any future iterations of the second control mode M2. However, if the cooking utensil temperature $T_{sensed}$ is greater than the disabling threshold temperature $T_{resume}$, controller 30 may continue to provide power to heating source 24 according to the third control mode M3.

At any point after heating source 24 has been activated, the user may select to turn off the heating source, e.g., when a cooking operation is complete or for any other reason. Thus, controller 30 also may determine whether heating source 24 should be deactivated, i.e., if the user has selected to deactivate or turn off heating source 24. More particularly, controller 30 may determine heating source 24 should be deactivated based on an input by a user of cooking appliance 10, e.g., the user may manipulate a user control 18 that signals to controller 30 that heating source 24 should be deactivated. If controller 30 determines the user has selected to deactivate the heating source, controller 30 deactivates heating source 24. As stated, a user may select to deactivate heating source 24 at any point after the heating source is activated, such that controller 30 may determine at any point in method 500 after step 502 that heating source 24 should be deactivated. That is, method 500 may include a step of determining whether heating source 24 should be deactivated at or between any appropriate step or steps within the method and is not limited to providing the step of determining whether heating source 24 should be deactivated at any particular point(s) within method 500.

It will be appreciated that method 500 may be utilized with one or more heating sources 24 of cooking appliance 10. That is, controller 30 may control the heat output of one or more heating sources 24 of appliance 10 according to method 500. In some embodiments, the power $P_{HS}$ provided to every heating source 24 may be regulated according to method 500, but in other embodiments, only one or only a portion of the heating sources 24 of appliance 10 may be regulated using method 500. That is, not all of the heating sources 24 of appliance 10 may utilize the foregoing algorithm; some of the heating sources 24 might not have a temperature limiting system or might utilize an alternative temperature limiting system than as described with respect to method 500. However, where the temperature limiting system of method 500 is utilized, each heating source 24 preferably has its own unique temperature sensor 26 and a corresponding energy control device 32 modulated by a uniquely-calculated $P_{HS}$ value.

Figure 6:
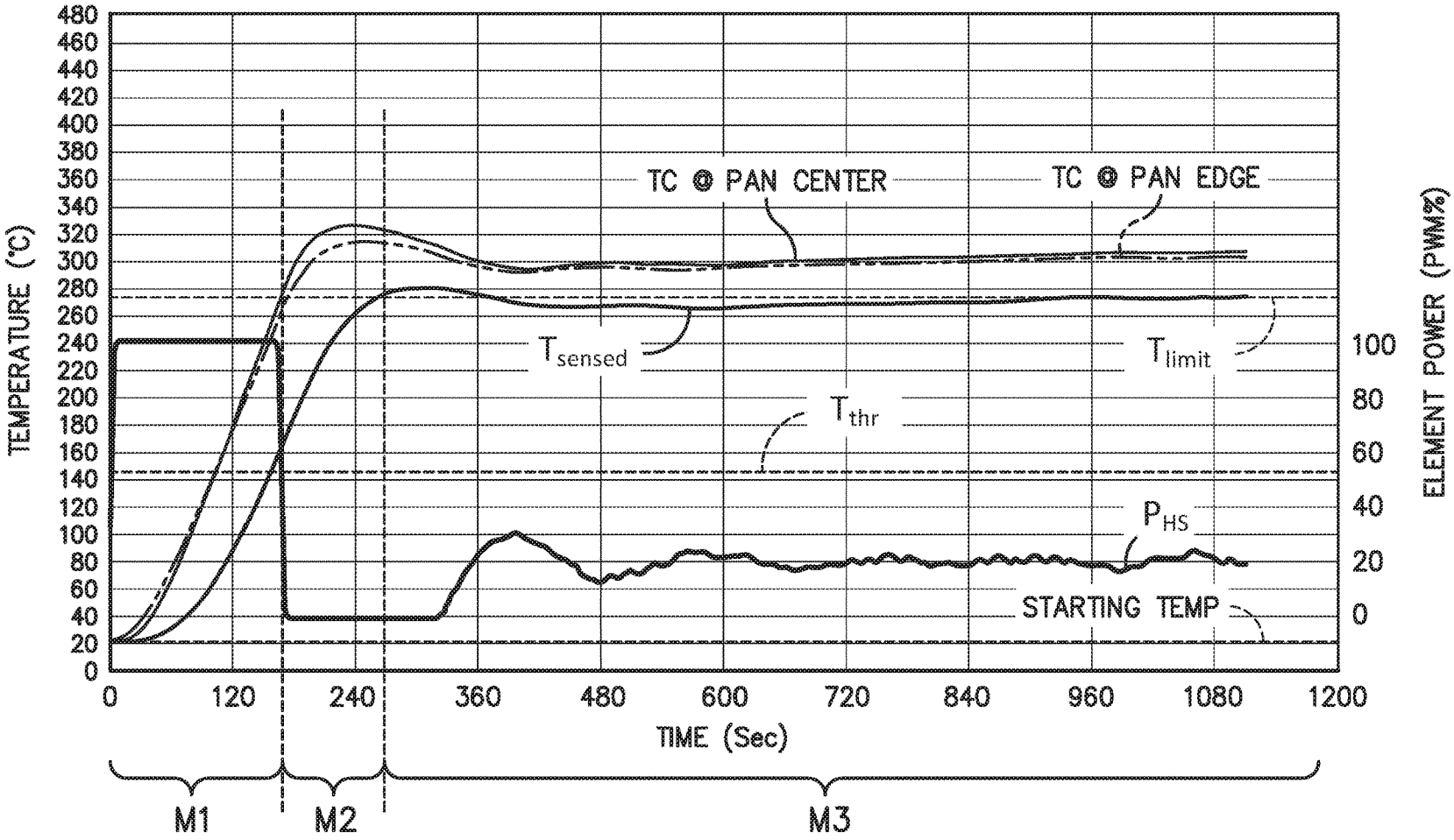
FIG. 6 provides a graph of cooking utensil temperature and heating source power over time for a lightly-loaded cooking utensil, according to an exemplary embodiment of the present subject matter.

FIG. 6 provides a graph illustrating an example embodiment of method 500. In the depicted embodiment, the enabling threshold temperature $T_{thr}$ is approximately 145° C., a temperature slightly above the temperature which typically is reported by sensor 26 when water is being boiled (sensor 26 typically reports 125° C. to 135° C. to controller 30 as the sensed temperature of boiling water due to, e.g., stray infrared energy from the heating source and drip try impinging on the sensor); the target temperature limit $T_{limit}$ is approximately 275° C., a temperature below the upper range of temperature sensor 26 and within the upper range of typical cooking conditions but well below an oil self-ignition temperature of about 400° C.; and the disabling threshold temperature $T_{resume}$ is approximately 120° C., a temperature at which the control system will resume allowing heating source 24 to operate at full power as there is little likelihood of producing an unsafe condition of cooking appliance 10. The minimum power level $P_{min}$ is about one percent (1%), e.g., heating source 24 is on for 1% of its duty cycle and off for 99% of its duty cycle or a gas flow control valve is 1% open, where the minimum power level $P_{min}$ represents a power level below which heating source 24 is considered to be off. The predetermined time interval limit $t_{turn_off}$ is about 80 seconds, and the threshold time interval $t_{thr}$ is approximately 120 seconds. The proportional gain factor $K_p$ is approximately 1.3 and the integral gain factor $K_i$ is about 0.004. Of course, other values of the enabling threshold temperature $T_{thr}$, target temperature limit $T_{limit}$, disabling threshold temperature $T_{resume}$, minimum power level $P_{min}$, predetermined time interval limit $t_{turn_off}$, threshold time interval $t_{thr}$, and the gain factors $K_p$ and $K_i$ may be used as well.

As illustrated in FIG. 6, in the period M1, controller 30 regulates the power $P_{HS}$ provided to heating source 24 according to the first control mode M1. For the depicted embodiment, the power level input is HIGH and heating source 24 is operated at a full or 100% duty cycle. As the cooking utensil temperature $T_{sensed}$ rises, controller 30 monitors the slope of the cooking utensil temperature $T_{sensed}$ and calculates the time interval $t_{limit}$ to reach target temperature limit $T_{limit}$. When the time to target is 80 seconds or less, i.e., less than or equal to the predetermined time interval limit $t_{turn_off}$, controller 30 transitions to the second control mode M2 and the power to heating source 24 is reduced to the minimum power level $P_{min}$. When the cooking utensil temperature $T_{sensed}$ reaches the target temperature limit $T_{limit}$, or the power had been reduced to its minimum value for a time greater than time $t_{thr}$, controller 30 transitions to the third control mode M3 and provides power $P_{HS}$ to heating source 24 according to the second control algorithm, which regulates the cooking utensil temperature $T_{sensed}$ to approximately the target temperature limit $T_{limit}$. That is, controller 30 modulates the power $P_{HS}$ provided to heating source 24 such that the cooking utensil temperature remains substantially equal to the target temperature limit $T_{limit}$. Although not illustrated in FIG. 6, it will be appreciated that if the user selected to lower the power level $P_{HS}$ of heating source 24, controller 30 may determine to transition to providing power to heating source 24 according to the first control mode M1, and controller 30 may modulate the power level $P_{HS}$ such that the cooking utensil temperature $T_{sensed}$ is approximately equal to another temperature that is less than the target temperature limit $T_{limit}$ and that is based on the power level input by the user. In other words, if the user later selects a lower power level setting, the temperature of cooking utensil 12 (and its contents if any) will drop and eventually stabilize at a temperature that is not controlled by the second or third control modes.

As depicted in FIG. 6, the temperature of cooking utensil 12 can be limited to a maximum temperature such as the target temperature limit $T_{limit}$. By limiting the temperature of a cooking utensil 12 positioned on a heating source of the cooking appliance, the temperature of any food items within the cooking utensil also may be limited, which can help prevent unsafe or undesirable conditions such as fire, smoke, and the like. More particularly, regulating the cooking utensil temperature to remain at or below a predetermined maximum temperature may help eliminate or avoid cooking fires commonly associated with grease or cooking oils, which can ignite due to excessive utensil temperatures.

Figure 7:
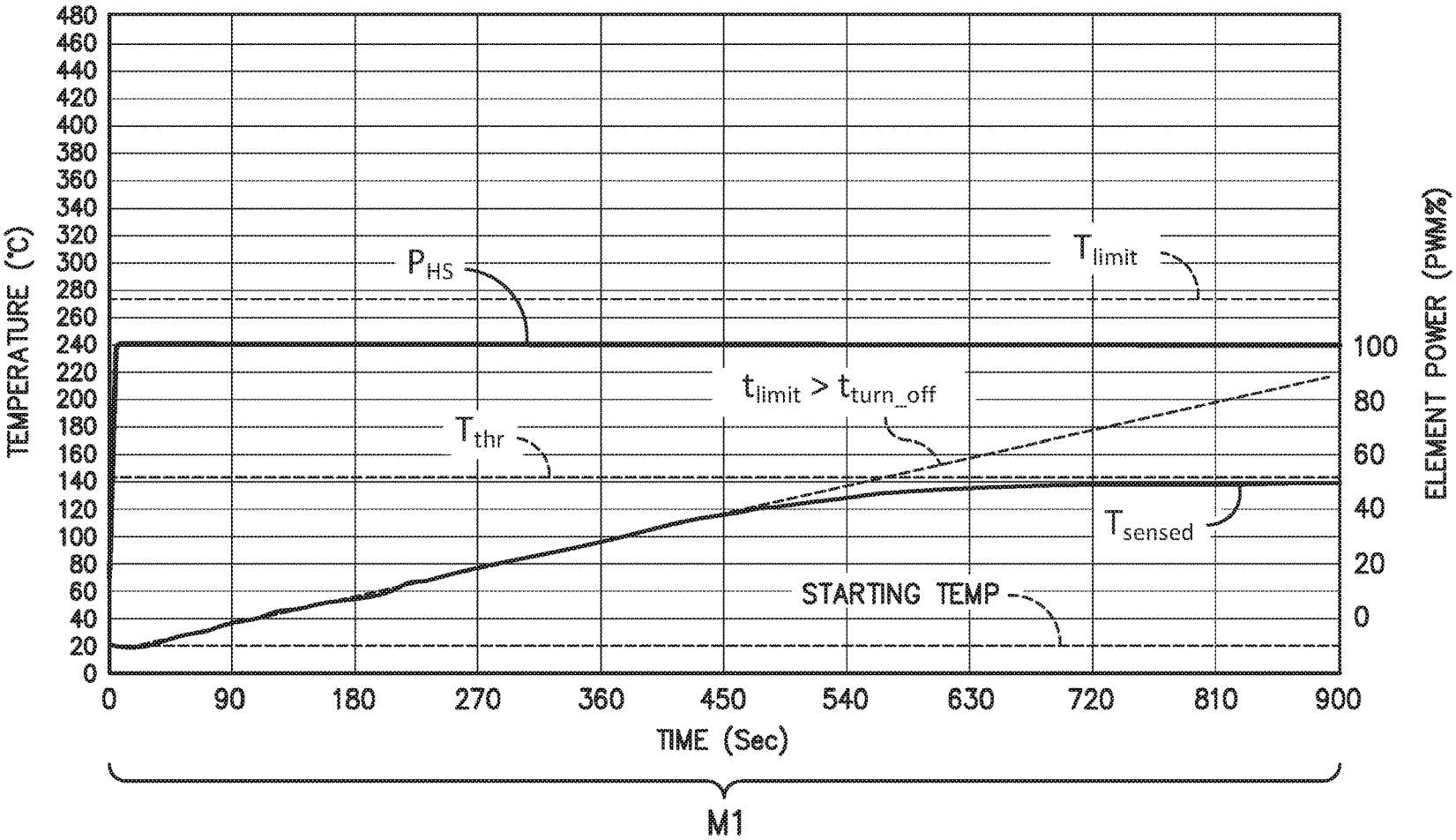
FIG. 7 provides a graph of cooking utensil temperature and heating source power over time for a heavily-loaded cooking utensil, according to an exemplary embodiment of the present subject matter.

FIG. 7 provides a graph illustrating another exemplary embodiment of method 500. Whereas FIG. 6 depicts the heating of a lightly loaded cooking utensil 12 (e.g., a skillet with a thin layer of cooking oil therein), FIG. 7 depicts the heating of a heavily loaded cooking utensil 12 (e.g., a large pot of water). In the depicted embodiment, the various parameters have the same values as given with respect to the embodiment illustrated in FIG. 6. As shown in FIG. 7, cooking utensil 12 and any food items therein heat up more slowly than as depicted in FIG. 6 because the thermal load (e.g., mass and specific heat) on heating source 24 is much larger than the embodiment of FIG. 6. Further, the cooking utensil temperature $T_{sensed}$ remains below the threshold temperature $T_{thr}$ such that the time interval $t_{limit}$ to reach target temperature limit $T_{limit}$ remains greater than the threshold time interval limit $t_{turn_off}$. Accordingly, throughout time period illustrated in FIG. 7, controller 30 provides power to heating source 24 according to the first control mode M1 and does not transition to other control modes. Thus, it will be understood that the cooking performance of cooking appliance 10, e.g., when heating a large food load such as when the user is cooking spaghetti, is not adversely impacted by the addition of the temperature limiting system described herein.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for operating a cooking appliance, the method comprising:

providing power to the heating source according to a first control mode, the first control mode comprising calculating a time interval $t_{limit}$ for a temperature of a cooking utensil positioned on the heating source to reach a target temperature limit $T_{limit}$;

determining whether the time interval $t_{limit}$ to reach the target temperature limit $T_{limit}$ is less than or equal to a predetermined time interval limit $t_{turn_off}$ and, if so, then providing power to the heating source according to a second control mode, the second control mode comprising reducing the heating source power to a minimum power level $P_{min}$ and incrementing a timer $t_{off}$;

determining whether the timer $t_{off}$ has surpassed a threshold time $t_{thr}$ and, if so, then providing power to the heating source according to a third control mode, wherein power is provided to the heating source in the third control mode using a proportional-integral or proportional-integral-derivative control algorithm.

2. The method of claim 1, wherein the first control mode comprises providing power to the heating source based on a power level input.

3. The method of claim 1, wherein a temperature sensor contacts a bottom surface of the cooking utensil to sense the temperature of the cooking utensil.

4. The method of claim 1, further comprising, if the time interval $t_{limit}$ to reach the target temperature limit $T_{limit}$ is greater than the predetermined time interval limit $t_{turn_off}$, determining whether the temperature of the cooking utensil is at least equal to the target temperature limit $T_{limit}$ and, if so, then proceeding to providing power to the heating source according to the second control mode.

5. The method of claim 4, further comprising, if the temperature of the cooking utensil is less than the target temperature limit $T_{limit}$, continuing to provide power to the heating source according to the first control mode.

6. The method of claim 1, further comprising, if the time interval $t_{limit}$ to reach the target temperature limit $T_{limit}$ is less than or equal to the predetermined time interval limit $t_{turn_off}$, determining whether the temperature of the cooking utensil is at least equal to an enabling threshold temperature $T_{thr}$ before proceeding to providing power to the heating source according to the second control mode.

7. The method of claim 1, further comprising, if the timer $t_{off}$ has not surpassed the threshold time $t_{thr}$, determining whether a temperature of a cooking utensil positioned on the heating source is at least equal to the target temperature limit $T_{limit}$ and, if so, then proceeding to providing power to the heating source according to the third control mode.

8. The method of claim 7, further comprising, if the temperature of the cooking utensil is less than the target temperature limit $T_{limit}$, determining whether the temperature of the cooking utensil is less than or equal to a disabling threshold temperature $T_{resume}$ and, if so, then returning to providing power to the heating source according to the first control mode.

9. The method of claim 1, further comprising determining whether to transition from the second control mode to the first control mode and, if so, then returning to providing power to the heating source according to the first control mode.

10. The method of claim 9, wherein determining whether to transition from the second control mode to the first control mode comprises comparing a temperature of a cooking utensil positioned on the heating source to a disabling threshold temperature $T_{resume}$.

11. The method of claim 1, further comprising determining whether to transition from the third control mode to the first control mode and, if so, then returning to providing power to the heating source according to the first control mode.

12. The method of claim 11, wherein determining whether to transition from the third control mode to the first control mode comprises comparing a temperature of a cooking utensil positioned on the heating source to a disabling threshold temperature $T_{resume}$.

13. A cooking appliance, comprising:

a heating source;

a temperature sensor, the temperature sensor positioned to sense the temperature of a bottom surface of a cooking utensil when the cooking utensil is placed on or adjacent to the heating source;

an energy control device for modulating the power provided to the heating source;

a controller, the controller in operative communication with the temperature sensor and the energy control device, the controller configured for providing power to the heating source according to a first control mode, the first control mode comprising calculating a time interval $t_{limit}$ for a temperature of a cooking utensil positioned on the heating source to reach a target temperature limit $T_{limit}$;

determining whether the time interval $t_{limit}$ to reach the target temperature limit $T_{limit}$ is less than or equal to a predetermined time interval limit $t_{turn_off}$ and, if so, then providing power to the heating source according to a second control mode, the second control mode comprising reducing the heating source power to a minimum power level $P_{min}$ and incrementing a timer $t_{off}$;

determining whether the timer $t_{off}$ has surpassed a threshold time $t_{thr}$ and, if so, then providing power to the heating source according to a third control mode, wherein power is provided to the heating source in the third control mode using a proportional-integral or proportional-integral-derivative control algorithm.

14. The cooking appliance of claim 13, wherein the temperature sensor is a spring-loaded temperature sensor.

15. The cooking appliance of claim 13, further comprising a shield extending circumferentially around the temperature sensor.

16. A cooking appliance, comprising:

a heating source;

a temperature sensor, the temperature sensor positioned to sense the temperature $T_{sensed}$ of a bottom surface of a cooking utensil when the cooking utensil is placed on or adjacent to the heating source;

an energy control device for modulating the power provided to the heating source;

a controller, the controller in operative communication with the temperature sensor and the energy control device, the controller configured for providing power to the heating source according to a first control mode, the first control mode comprising calculating a time interval $t_{limit}$ for a temperature of a cooking utensil positioned on the heating source to reach a target temperature limit $T_{limit}$;

determining whether the time interval $t_{limit}$ to reach the target temperature limit $T_{limit}$ is less than or equal to a predetermined time interval limit $t_{turn_off}$ and, if so, then providing power to the heating source according to a second control mode, the second control mode comprising reducing the heating source power to a minimum power level $P_{min}$ and incrementing a timer $t_{off}$;

determining whether the timer $t_{off}$ has surpassed a threshold time $t_{thr}$ and, if so, then providing power to the heating source according to a third control mode;

comparing the temperature $T_{sensed}$ sensed by the temperature sensor to a disabling threshold temperature $T_{resume}$ to determine if the temperature $T_{sensed}$ of the cooking utensil is less than the disabling threshold temperature $T_{resume}$ and, if so, then providing power to the heating source according to the first control mode, wherein power is provided to the heating source in the third control mode using a proportional-integral or proportional-integral-derivative control algorithm.

17. The cooking appliance of claim 16, wherein the controller is further configure for, if the time interval $t_{limit}$ to reach the target temperature limit $T_{limit}$ is greater than the predetermined time interval limit $t_{turn_off}$, determining whether the temperature of the cooking utensil is at least equal to the target temperature limit $T_{limit}$ and, if so, then proceeding to providing power to the heating source according to the second control mode but, if not, then continuing to provide power to the heating source according to the first control mode.

18. The cooking appliance of claim 16, wherein the controller is further configured for, if the timer $t_{off}$ has not surpassed the threshold time $t_{thr}$, determining whether a temperature of a cooking utensil positioned on the heating source is at least equal to the target temperature limit $T_{limit}$ and, if so, then proceeding to providing power to the heating source according to the third control mode, but if the temperature of the cooking utensil is less than the target temperature limit $T_{limit}$, determining whether the temperature of the cooking utensil is less than or equal to the disabling threshold temperature $T_{resume}$ and, if so, then returning to providing power to the heating source according to the first control mode.

19. The cooking appliance of claim 16, wherein power is provided to the heating source in the third control mode using a proportional-integral control algorithm wherein the power provided to the heating source equals the sum of an integral term I and the product of a proportional gain factor $K_p$ and a temperature error $T_{err}$.

20. The cooking appliance of claim 16, wherein the time interval $t_{limit}$ is calculated as a difference between the target temperature limit $T_{limit}$ and a current cooking utensil temperature $T_{sensed}(\mathbf{0})$, divided by a rate of change $\Delta T$ of the temperature $T_{sensed}$ sensed by the temperature sensor.

* * * * *